United States Patent [19]

Fosnaugh

[11] Patent Number: 4,861,286

[45] Date of Patent: Aug. 29, 1989

[54] ELECTRICAL CONNECTOR DEVICE

[75] Inventor: William L. Fosnaugh, Libertyville, Ill.

[73] Assignee: ACCO World Corporation, Wheeling, Ill.

[21] Appl. No.: 77,814

[22] Filed: Jul. 27, 1987

[51] Int. Cl.[4] ..... H01R 25/00

[52] U.S. Cl. ..... 439/651; 439/620; 439/733; 439/695

[58] Field of Search ..... 439/56, 737, 603, 581, 439/101, 739, 869, 738, 733, 741, 742, 870, 720, 650, 651, 652, 654, 655, 658, 695, 620

[56] References Cited

U.S. PATENT DOCUMENTS

| | | | |
|---|---|---|---|
| 2,323,736 | 7/1943 | Gousley | 439/172 |
| 2,782,392 | 2/1957 | Stolle . | |
| 2,964,725 | 12/1960 | Lehr et al. | 439/737 |
| 3,275,888 | 9/1966 | Dresser . | |
| 3,368,110 | 2/1968 | Taylor . | |
| 3,369,153 | 2/1968 | Arnold et al. . | |
| 3,421,136 | 1/1969 | Bowley et al. . | |
| 3,452,252 | 6/1969 | Mapham . | |
| 3,585,555 | 6/1971 | Yamada . | |
| 3,784,964 | 1/1974 | Newman et al. | 439/603 |
| 3,840,781 | 10/1974 | Brown . | |
| 4,035,045 | 7/1977 | Trevithick | 439/101 |
| 4,071,872 | 1/1978 | Phillips, Jr. . | |
| 4,075,676 | 2/1978 | Phillips, Jr. . | |
| 4,081,779 | 3/1978 | Ranzanigo . | |
| 4,095,163 | 6/1978 | Montague . | |
| 4,156,838 | 5/1979 | Montague . | |
| 4,191,985 | 3/1980 | Phillips, Jr. . | |
| 4,217,619 | 8/1980 | Tibolla . | |
| 4,259,705 | 3/1981 | Stifter . | |
| 4,263,637 | 4/1981 | Draper et al. . | |
| 4,398,647 | 8/1983 | Ackerman . | |
| 4,434,396 | 2/1984 | Montague . | |
| 4,438,477 | 3/1984 | Cawley . | |
| 4,491,903 | 1/1985 | Montague . | |
| 4,500,160 | 2/1985 | Bertsch | 439/56 |
| 4,500,862 | 2/1985 | Shedd . | |
| 4,502,749 | 3/1985 | Forney, Jr. et al. | 439/581 |
| 4,539,617 | 9/1985 | Delaney et al. . | |
| 4,547,827 | 10/1985 | Shedd . | |
| 4,571,656 | 2/1986 | Ruckman . | |
| 4,587,588 | 5/1986 | Goldstein . | |
| 4,602,308 | 7/1986 | Montague . | |

FOREIGN PATENT DOCUMENTS

| | | |
|---|---|---|
| 1238670 | 7/1960 | France . |
| 935234 | 9/1961 | United Kingdom . |

*Primary Examiner*—David Pirlot

*Attorney, Agent, or Firm*—Pennie & Edmonds

[57] ABSTRACT

A connector device for an electrical surge protector includes a base having at least one yoke defining a mounting aperture, at least one terminal having a mounting hole aligned with the mounting aperture of the yoke, and a pin extending through the hole of the terminal and the yoke aperture to hold the terminal in a predetermined position in assembly of the surge protector.

5 Claims, 1 Drawing Sheet

FIG. 1
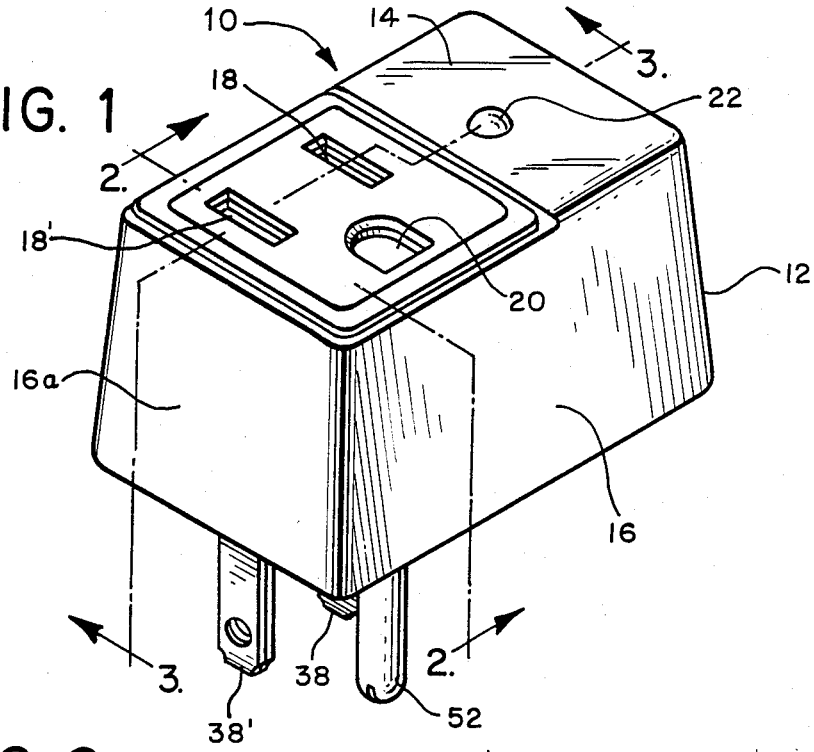
FIG. 2
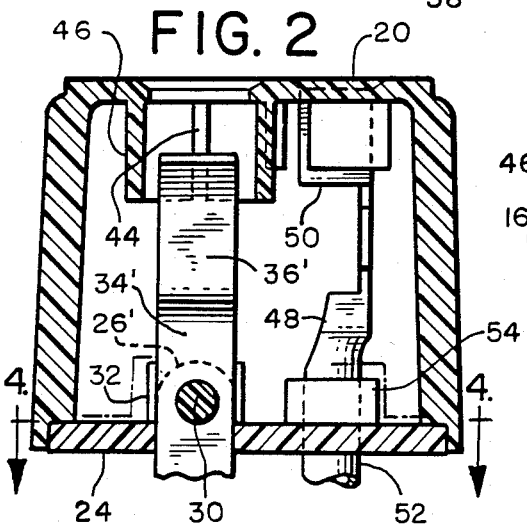
FIG. 3
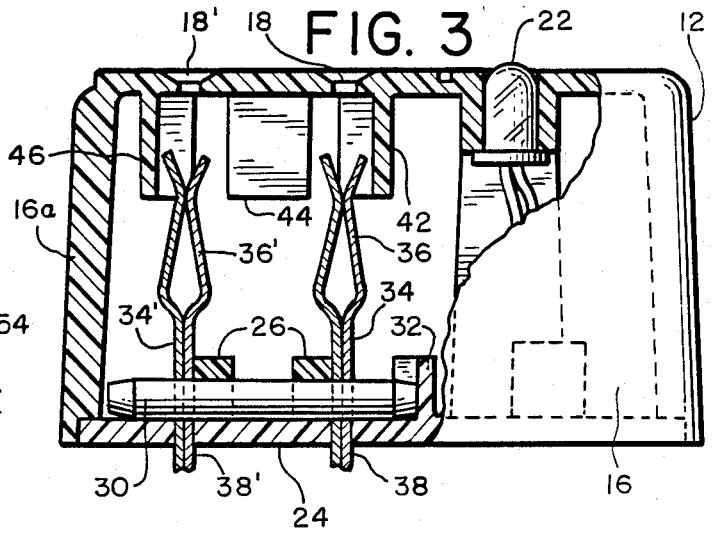
FIG. 4
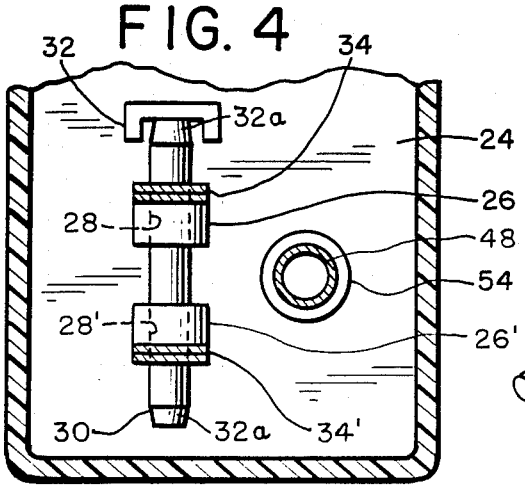
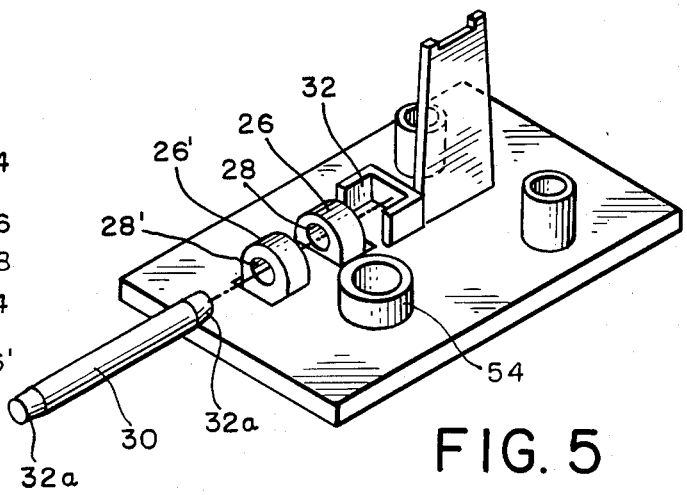
FIG. 5

ELECTRICAL CONNECTOR DEVICE

FIELD OF THE INVENTION

The invention relates to electrical connectors in general, and in particular to the assembly of voltage surge protectors for placement between an electrical outlet and a plug leading to an electrical device.

BACKGROUND OF THE INVENTION

Electrical devices known as voltage surge protectors or suppressors are well known in the art. Typically, these devices include a pair of terminals that are secured within a housing and connected to the circuitry that accomplishes the desired electrical function.

Although there are many ways of suppressing voltage spikes, a simple circuit consists of a first bidirectional voltage sensitive breakdown element connected between the surge protector terminals and a second such element connected between one of the terminals and ground. A pair of Zener diodes connected back to back forms such a bidirectional breakdown element.

In operation, any transient voltage spike that appears across the terminals (or between the terminals and ground) and exceeds the threshold of the breakdown element causes that element to conduct, thus shunting current away from whatever load is connected to the surge protector.

The surge protector terminals typically include a prong (male) end, a receptacle (female) end and an intermediate connecting portion. The prongs are designed to be plugged into a standard electrical outlet and the receptacles are adapted to receive the prongs of a standard electrical plug. In some devices, each surge protector prong is offset with respect to its respective receptacle to form a surface that is held in place by the internal dimensions of the device housing. Other types of devices use "pass-through" or "in-line" terminals that are generally straight conductors having a prong at one end and a receptacle at the other end.

There are several known ways to secure "in-line" terminals within a housing, for example, by friction fit, or with mechanical fasteners. Known connectors either do not provide the internal stability required by "in-line" terminals or require the use of fasteners that are difficult to handle because of their small size. U.S. Pat. No. 4,500,160 (Bertsch) discloses another method of securing terminals within a housing of a surge protector. This type of arrangement has the general disadvantage of requiring relatively complex molded parts.

It is therefore an object of this invention to provide an electrical connector device that can be simply and inexpensively assembled and in which the terminals are securely held.

SUMMARY OF THE INVENTION

The connector device of the present invention includes a base having at least one, and preferably two, performed yokes located adjacent to openings through which the prong ends of the surge protector terminals pass in assembly. The terminals contain holes that align with apertures in the yokes when the terminals are in position. A pin extends through the holes in the terminals and the yoke apertures to retain the terminals in the desired position. In a preferred embodiment, a stop located adjacent to a yoke limits movement of the pin in one direction. Movement in the opposite direction is limited by a wall of the housing when the entire device is assembled.

The features and advantages of the invention will be further understood upon consideration of the following description of an embodiment taken in conjunction with the drawings, in which:

BRIEF DESCRIPTION OF THE DRAWINGS

FIG. 1 is a perspective view of a surge protector incorporating a presently preferred embodiment of the invention;

FIG. 2 is a cross-sectional view of FIG. 1 taken along the line 2—2;

FIG. 3 is a cross-sectional view of FIG. 1 taken along the line 3—3;

FIG. 4 is a cross-sectional view of the base of the surge protector of FIG. 2 taken along the line 4—4; and FIG. 5 is an exploded perspective view of the base of the surge protector.

DETAILED DESCRIPTION OF THE PRESENTLY PREFERRED EMBODIMENT

FIG. 1 illustrates a surge protector 10 that includes a molded plastic housing or cover 12 having an end wall 14, and a plurality of side walls 16. End wall 14 includes a pair of openings 18, 18' for receiving the prongs of a standard electrical plug (not shown). End wall 14 also contains a third opening 20 adapted to receive the ground terminal of the electrical plug, and an indicator 22, such as an LED, that displays the operational status of the device. It will be understood that the circuitry for surge protectors of the type for which the present invention has been particularly adapted is well known, and forms no part of the present invention.

Cover 12 is adapted to receive a base or back plate 24. Base 24 includes a pair of yokes 26, 26' which are preferably substantially perpendicular flanges integrally molded into the base. The flanges include openings or apertures 28, 28' through which a retaining pin 30 extends. Adjacent yokes 26, 26' are terminal openings 27, 27' through which the terminals extend. Base 24 also includes a stop 32 that restricts the insertion movement of pin 30.

FIGS. 2 and 3 depict the general construction of the "pass-through" or "in-line" terminals 34, 34'. These standard terminals each contain a receptacle (female) end 36, 36'0 aligned with the openings 18, 18' of cover 12, and are adapted to receive the prongs of a standard plug. Extending linearly from the receptacle ends 36, 36' are male prongs 38, 38' which are inserted into a standard electrical outlet.

On each terminal 34, 34', located intermediate the prong and receptacle ends, are mounting holes 40, 40' that align with the apertures 28, 28' of the yokes 26, 26'.

As shown in FIG. 2, surge protector 10 also includes a ground electrode 48 which has a receptacle 50 aligned with opening 20 in cover 12 to receive the ground prong of the electric plug, if present. The ground electrode 48 also includes a prong 52 that extends through an opening 54 of base 24 for insertion into the ground receptacle of a standard outlet.

After the terminals 34, 34' are placed in the desired position, pin 30 is inserted through the aligned holes and apertures until one end abuts stop 32. A slight bevel 32a is provided on each end of the pin 32 to facilitate insertion. The suppression circuitry (not shown) is added and the cover 12 is attached to the base 24 in any appropriate manner. Sidewall 16a of cover 12 acts to prevent retaining pin 30 from moving longitudinally. Cover 12 also contains internal insulating partitions 42, 44, 46 that prevent receptacle ends 36, 36' from coming into contact with each other or with ground terminal 48, as shown in FIGS. 2 and 3. These partitions also provide proper support for the receptacle ends.

Thus, while the invention has been described with reference to a particular embodiment, those of skill in the art will recognize modifications in material and arrangement which will nevertheless fall within the scope of the invention.

I claim:

1. A connector device comprising a planar base having a yoke defining a mounting aperture having an axis parallel to the planar base and a terminal opening located adjacent to said yoke;

a terminal oriented substantially perpendicular to the planar base and extending through the terminal opening of said base and containing a mounting hole having an axis parallel to the planar base and such hole aligned with the mounting aperture of said yoke; and a pin extending parallel to the planar base through the mounting hole of said terminal and the aperture of said yoke to hold said terminal in place.

2. A terminal connector device for an electrical surge protector adapted to be plugged into an electrical outlet and adapted to receive an electrical plug comprising a base having a pair of aligned flanges defining mounting apertures, and terminal openings located adjacent to said flanges;

a pair of terminals, each having a prong extending through the terminal openings of said base for engaging said outlet and a receptacle for receiving said plug, each terminal also containing mounting holes aligned with the mounting apertures of said flanges;

a pin extending through the mounting holes of each of said terminal and the apertures of said flanges;

a stop for engaging one end of said pin upon insertion of said pin through said holes and apertures; and a cover having means for engaging the pin end opposite said stop, and having further openings permitting the receptacles of said terminals to receive the prongs of a plug.

3. A connector device for an electrical surge protector comprising:

a base having a pair of aligned yokes defining mounting apertures, with terminal openings located adjacent to said yokes;

a pair of terminals, each having a prong extending through the terminal openings of said base for engaging an outlet and a receptacle for receiving the prong of a plug, each terminal also containing mounting holes aligned with the mounting aperture of said yokes; and a pin extending through the mounting holes of said terminals and the apertures of said yokes.

4. A connector device comprising a base having a first and second yoke, each defining a mounting aperture and terminal openings adjacent each yoke;

a first and second terminal extending through each terminal opening with each terminal containing a mounting hole aligned with a mounting hole in said yoke; and a pin extending through the mounting holes of the terminals and the apertures of the yokes to hold the terminals in place.

5. The connector device of claim 4 wherein said base includes a stop for engaging one end of said pin, and further comprising a cover having means for engaging an opposite end of said pin when said cover is mounted on said base.

* * * * *